US005495821A

United States Patent [19]

Brewer

[11] Patent Number: 5,495,821

[45] Date of Patent: Mar. 5, 1996

[54] ANTI-FOULING TETHERING DEVICE FOR DISPLAYING FLAGS

[76] Inventor: Omer F. Brewer, 30 S. Shrub La., N. Fort Myers, Fla. 33917

[21] Appl. No.: 296,453

[22] Filed: Aug. 26, 1994

[51] Int. Cl.[6] ..... G09F 17/00

[52] U.S. Cl. ..... 116/174; 116/173; 248/520

[58] Field of Search ..... 116/173, 174; 248/511, 518, 519, 520, 530

[56] References Cited

U.S. PATENT DOCUMENTS

| | | | |
|---|---|---|---|
| 2,794,414 | 6/1957 | Reifschneider | 116/173 |
| 2,799,240 | 7/1957 | Andrews | 116/174 |
| 3,183,886 | 5/1965 | Moffitt, Jr. | 116/173 |
| 3,395,577 | 8/1968 | Keim | 116/174 |
| 3,477,161 | 11/1969 | Drexler | 116/174 X |
| 3,595,202 | 7/1971 | Visitacion | 116/174 |
| 3,680,526 | 8/1972 | Buffington, Jr. | 116/174 |
| 3,706,297 | 12/1972 | Voorhees | 116/174 |
| 3,792,680 | 2/1974 | Allen | 116/173 |
| 3,820,500 | 6/1974 | Merryweather | 116/174 |
| 3,941,083 | 3/1976 | Morse | 116/173 |
| 4,452,167 | 6/1984 | Burroughs | 116/173 |
| 4,603,652 | 8/1986 | Thibault et al. | 116/174 |
| 4,864,962 | 9/1989 | Knebl | 116/174 |

*Primary Examiner*—William A. Cuchlinski, Jr.
*Assistant Examiner*—Willie Morris Worth

[57] ABSTRACT

An anti-fouling device for tethering a flag or banner to a supporting member, mainly a small, house-mounted flag pole. This device includes an externally radiused, tapered housing, mounted on top end of flag pole, with a hole through apex leading into a recessed area of the housing, and a tether, with one end secured into the recessed area by way of the apex hole, and with opposite end of the tether secured to top grommet of the flag or banner. By this tether from the flag to the top of the pole, with nothing to obstruct the movement, and with freedom for the flag to move up and down and around in a 360-degree circle, and the effect of the weight of the flag being reduced by not being cantilevered from the top of the pole, binding cannot occur. This device also includes an additional tether connecting lower grommet of the flag to a floating link which surrounds a pair of guides that are positioned and secured onto flagpole adjacent to the lower grommet of flag. This tether from flag to floating link surrounding the pole allows the flag to float freely around the pole when pole is placed in any vertical, angular or horizontal position.

14 Claims, 2 Drawing Sheets

ANTI-FOULING TETHERING DEVICE FOR DISPLAYING FLAGS

BACKGROUND OF THE INVENTION

1. Field of Invention

The present invention relates to flags, banners, and flag poles, more specifically for devices and methods therefor to elevate the flag and tether it to a supporting member to prevent wrapping or fouling, be it displayed vertically, horizontally or angularly.

2. Description of Prior Art

Flags wrapped around a pole attached to a structure is a common sight, however not the way "Old Glory" should be perceived. This is especially common with the small house flags that are so prevalent around the world. They are most commonly displayed in an angular position from a house or structure at a height so the flag will not drag the ground and for convenience of removing the flag at dusk. It is very limiting as to where the flag maybe displayed due to the restriction imposed by the shortness of the pole, and the entanglement of the flag around the pole.

Others have tried to solve this dilemma in various ways. U.S. Pat. No. 3,792,680 to Allen wherein discloses a flag directly connected to a swivel which is in a groove in a bushing mounted on the pole; the direct connection of the flag to the device of the Allen patent and the containment of the swivel connector in a groove would curtail the flag from flying freely, and the weight of the flag especially on the top connection causes a binding to occur.

U.S. Pat. No. 4,864,962 to Knebl, et al., discloses ring grooves cut into the pole with wire rings formed and put into these grooves with the flag directly attached to these wire rings. This has similarities to U.S. Pat. No. 3,792,680 to Allen, where the pole takes the place of the bushings by having grooves cut into it. This is more restrictive in that it would require a heavier gauge wall and like the Allen patent, the grooves and the direct connection cause a binding to occur.

U.S. Pat. No. 3,680,526 to Buffington places tubes over the pole with the flag secured to the tube. The weight and friction created by the tube and the direct connection of the flag will cause the flag to wrap, especially in an angular or horizontal position.

U.S. Pat. No. 3,941,083 to Morse has rings slipped over the pole with the flag attached to the rings. The rings are directly attached to the flag and the weight of the flag on the upper ring will cause a binding and will cause the flag to start spiraling and then wrap.

U.S. Pat. No. 3,820,500 to Merryweather has wire arms to control and stop the flag from rotating. This is expensive and really defeats the purpose of displaying a flag by restricting the movement.

U.S. Pat. No. 3,183,886 to Moffitt, Jr., has a continuous wire element along the leading edge of the flag from grommet to grommet with both ends forming coils around the pole, and then reconnecting to the flag. This restricts the movement of the flag and has direct connections.

U.S. Pat. No. 3,595,202 to Visitacion pertains to the top and bottom of the flag connected to a bar and then the bar is connected to arms extending from ring shaped members between discs. The Visitacion patent is cumbersome, expensive and it too cantilevers the weight out from the supporting member with a direct connection causing binding to occur.

U.S. Pat. No. 3,495,568 to Palinkos, U.S. Pat. No. 4,603,652 to Thibault, et al., U.S. Pat. No. 3,706,297 to Voorhies and U.S. Pat. No. 4,452,167 to Burroughs are not similar in what the present invention is providing.

Whatever their merits, none of the previously cited references accomplish the purposes of the present invention.

In all the previously cited circumstances, the flag is fastened directly to bars, arms, swivels, wire rings and the like; the flag is never allowed to fly free of a direct connection. The flag is always connected by the same means at the top and the bottom, even though the weight of the flag is primarily on the top connection and reacts differently than the connection on the bottom, while supported in a vertical or angular position. The bottom of the flag with very little weight on the connection is pushed around by the wind while the weight of the flag on the top connection is creating a binding situation that is only increased by the force of the wind, causing the flag to spiral and eventually wrap around the supporting member.

SUMMARY OF THE INVENTION

It is a principal object of the present invention to provide methods and means of displaying a flag in a vertical, angular or horizontal position without its wrapping or fouling about a support member, flag pole or supporting member, by tethering the flag to the supporting member.

It is also an object of the invention to produce an economical, easily assembled, workable solution to the problem of flag wrapping and fouling.

It is also an object of the invention to provide an easy method and means of concatenating the flag to and from the supporting member.

The foregoing objects can be accomplished by the unique way of tethering the flag or banner, at both top flag grommet and lower flag grommet. By tethering the lower flag grommet to a floating link which encircles a pair of guides located on the supporting member and by tethering the upper flag grommet to a pivot housing located on the top apex of the supporting member, this unique way of tethering the flag alleviates the weight of the flag cantilevered out from the axis of the supporting member, thereby eliminating the way for the flag to bind which causes the flag to wrap or foul. This allows much more freedom of movement of the flag and allows the flag tethered to supporting member to be displayed horizontally, vertically or angularly in stationary mounts or to be handheld as in flag and banner corps use. This allows the flag and banner corps to expand their maneuvers for a greater performance without the flags wrapping.

The supporting member extended by a plurality of sections and a mounting bracket used in conjunction with the aforesaid tethering means allows the common house flag to be mounted and displayed both horizontally or angularly from a vertical plane, such as a house, and also allows it to be mounted and displayed both angularly or vertically from a horizontal plane, such as a deck or patio. The extended support member with the tethered flag not only elevates the flag to a higher plane but promotes and widens the use by simplifying the way to display the flag.

The tethering of the flag or banner while being displayed from horizontal support member, which is fastened on each end from a vertical plane, is accomplished by locating the pair of guides and floating link adjacent to the top and lower grommets of each flag, thereby being able to display a multiple of flags at one time such as across a street or entrance.

Other and further objects, advantages and features of the present invention will be understood by reference to the following specification in conjunction with the annexed drawings.

DETAILED DESCRIPTION

Figure 2:
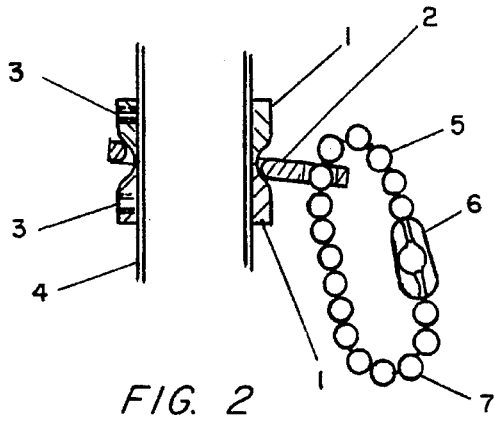
FIG. 2. Section through guides.

As shown in the drawings, the preferred device in accordance with the present invention includes a pair of guides [1], preferably being lightweight, rustproof aluminum, formed to enclose a flag pole, support member or supporting member [4], be it square, rectangular, round or any other shape, the outer perimeter of the pair of guides [1] being symmetrical about pair of guides [1] axis and the sides all being perpendicular and parallel to the pair of guides [1] axis, the opening formed to enclose the supporting member [4] does not necessarily have the same axis, however preferably so. The pair of guides [1] when joined together and where joined together are of concave shape, as shown in FIG. 2, the purpose being to provide way to get a floating link [2] in position, to guide the floating link [2], and for the floating link [2] to levitate. An area of the outer perimeter of the pair of guides [1], not inclusive of the concave shape has a hole that is tapped through to the opening for the supporting member [4]; this is for a set screw [3] to fasten the pair of guides [1] in place on the supporting member [4].

Figure 5:
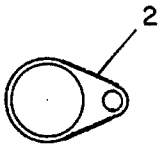
FIG. 5. Plan view of floating link.

The floating link [2], shown in FIG. 5, preferably lightweight, rustproof, aluminum, is of pennon shape with a hole placed at the widest end, and the face of the hole has the convex form. The hole diameter is of sufficient diameter to allow the floating link [2] to float up or down and around the concave-shaped diameter of the pair of guides [1] when placed around the joined pair of guides [1], the narrow end of the pennon-shaped floating link [2] has a small hole from which to tether a flag [13] to the floating link [2]. A tether [5] is a length of material, preferably stainless steel, beaded chain [7], with a connector [6], preferably stainless steel, on one end.

As shown in FIG. 2, once the pair of guides [1] are placed over the support member [4] with the floating link [2] encircling the concave perimeter of the pair of guides [1], locate the pair of guides [1] on top or uppermost section of the support member [4], adjacent to a lower grommet of the flag [13] and then fasten the pair of guides [1] in place with the set screws [3]; thread one end of the tether [5], comprising length of beaded chain [7], preferably stainless steel, and connector [6], preferably stainless steel, through the small hole of the floating link [2], thread the other end through the lower grommet of the flag [13] and connect the end of the beaded chain [7] to connector [6].

Figure 3:
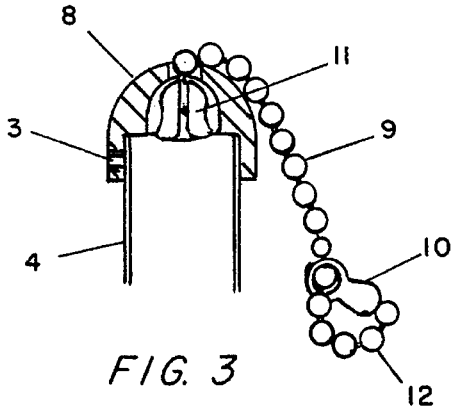
FIG. 3. Section through pivot housing.

A pivot housing [8], as shown in FIG. 3, preferably lightweight rustproof aluminum, formed to fit over the end of a round square, or any shape support member [4] top section. Also, the pivot housing [8] has a hole through the wall section that is tapped for set screw [3], located in the area where it fits over the support member [4] top section. Also, as shown in FIG. 3, the inside of the pivot housing [8] has a cavity with a concave spherical shape for pivot purposes; it also has a small hole at the cavity end from which to tether the flag [13] to apex of the pivot housing [8]. The outside end of pivot housing [8], opposite that formed to fit over the support member [4] top section, is tapered and radiused.

To attach the flag [13] at the top grommet, use a tether [12]; the tether [12] is a length of material, preferably stainless steel, beaded chain [9], and an eyelet connector [10] preferably stainless steel, on one end and a pendant [11] preferably stainless steel, on other end; disconnect the pendant [11] and thread loose end of the beaded chain [9] through the top flag grommet and then through the eyelet connector [10], then thread the same loose end of beaded chain [9] through the small hole of the apex of the pivot housing [8] and reconnect the pendant [11]; the pivot housing [8] with tether [12] attached is placed over the support member [4] top section and the set screw [3] is used to hold the pivot housing [8] in place. With the weight of the flag [13], the pendant [11] is pulled up into the concave spherical cavity. This allows the connection area of the upper portion of the flag [13 to be obstruction free. There are no rings, arms, snaps, extensions, etc., for the flag [13] to get hung up on and yet the flag [13] is maintained in its proper position and allowed to fly freely.

Figure 1:
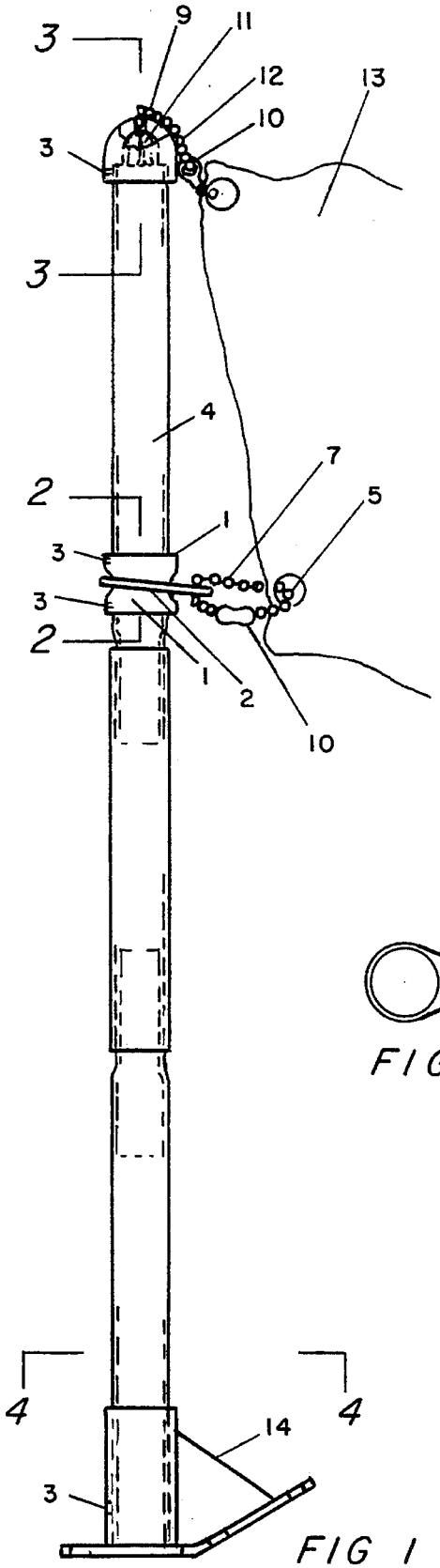
FIG. 1. Elevation view of assembly.

As shown in FIG. 1, the support member [4] is composed of a plurality of elongated members of lightweight rustproof material wherein lowest section has an extensible end for receiving lower end of center section; and lower end of lowest section and lower end of center section, are both shaped to fit into the receptacle of a mounting bracket [14]; lower end of uppermost section has an extensible end to fit into upper end of the center section; and the uppermost end of the upper section fits into the receptacle area of the pivot housing [8]. The shape of lower end of both lowest section and center section being the same allows the support member [4] to serve as a two-section or a multiple-section support member [4]; therefore when the flag [13] is flown from an angular or horizontal position from the mounting a bracket [14] mounted from a vertical plane, only the uppermost and center sections need be used. When the flag [13] is flown from a vertical or angular position from bracket [14] mounted from mounting a horizontal plane, a multiple-section supporting member [4] is used to elevate the flag [13] even higher.

Figure 4:
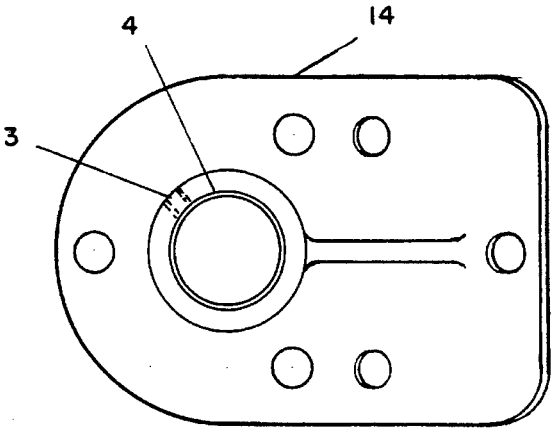
FIG. 4. Plan view of mounting bracket.

As shown in FIG. 1 and FIG. 4, the mounting bracket [14] is formed preferably of lightweight rustproof aluminum of angular shape with a raised boss on one end wit ha receptacle formed in the boss to receive the lower end of the support member [4]; the boss has a tapped hole through the wall section for a set screw to fasten the support member [4] in place. There is a gusset spanning the area between the boss and opposite leg, and mounting holes in both legs for attaching to a structure. The mounting holes in the same leg of the receptacle boss are for mounting the support member

[4] in a vertical or horizontal position. The mounting holes in the opposite leg are for mounting the support member [4] in an angular position.

Figure 7:
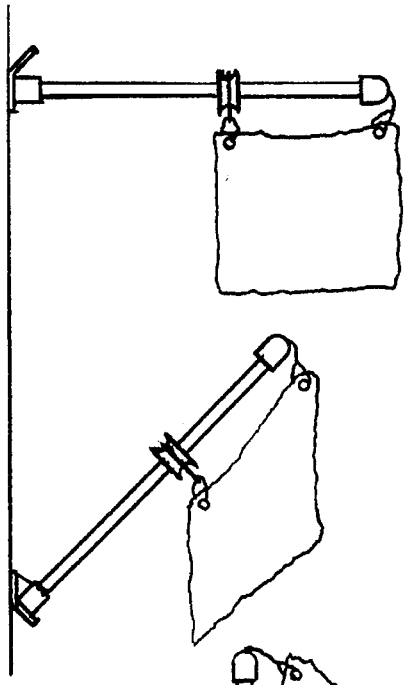
FIG. 7. Horizontal and angular methods of display from vertical plane.

As shown in FIG. 7, with the top of the flag tethered to the pivot housing apex on the support member top section and with bottom of the flag tethered to the floating link surrounding the pair of guides on the support member top section adjacent to the bottom of the flag, and the center section of the support member engaged with the top section, the flag may be displayed in a horizontal or angular position when the mounting bracket is mounted from a vertical plane.

Figure 6:
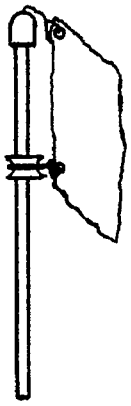
FIG. 6. Hand-held method of display.

The flag tethered in the aforesaid way to any support member, without the use of mounting bracket, is thereby able to be displayed by holding or waving the flag such as in a parade or flag corps program as shown in FIG. 6.

Figure 8:
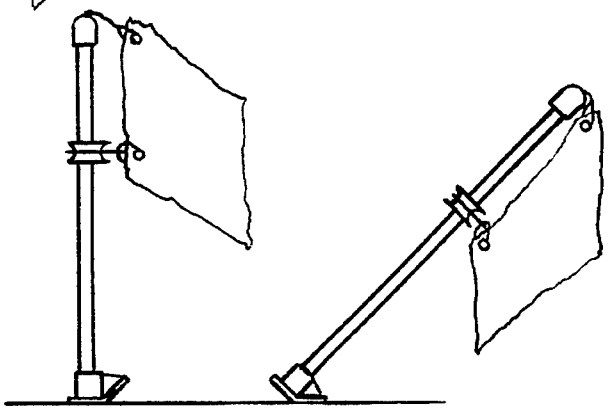
FIG. 8. Vertical and angular methods of display from horizontal plane.

As shown in FIG. 8, with the top and center sections of the support member engaged and with the flag tethered to the top section as above and the lowest section of the support member engaged with the center sections of the support member, the flag may be displayed in a vertical or angular position when the mounting bracket is mounted on a horizontal plane. Also, as shown in FIG. 8, the use of additional sections adds the height, when needed, to elevate the flag so it will not drag the ground, thereby allowing the flag to be mounted on a deck or patio with bracket support.

Figure 9:
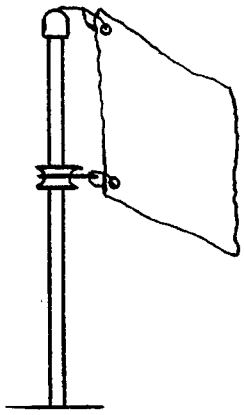
FIG. 9. Vertical method of display from terra firma.

Without using the mounting bracket, the lowest section of supporting member can be directly imbedded in concrete or another substance, as shown in FIG. 9, where no existing mounting surface is available for displaying the flag, in such places as a flower garden or yard.

Figure 10:
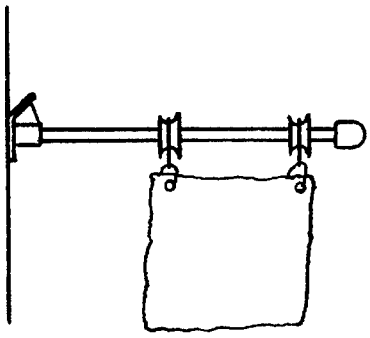
FIG. 10. Horizontal method of display from vertical plane.

The flag may be displayed, as in FIG. 10, from horizontal support member which is fastened to a vertical plane, by fastening onto the horizontal support member the pair of guides, with surrounding floating link adjacent to both top and bottom of the flag and providing a tether connection to each floating link to the flag.

Figure 11:
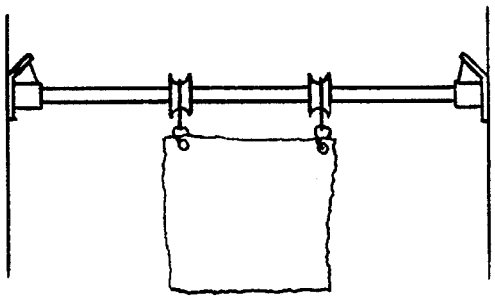
FIG. 11. Horizontal method of display between two vertical planes.

As shown in FIG. 11, the flag or flags in multiple may be displayed from horizontal support member, fastened at both ends, from a vertical plane by fastening onto the horizontal support member the pair of guides, with surrounding floating link, adjacent to both the top and the bottom of each flag and providing tether connection to each floating link to the flags.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A device to tether a flag or a banner to a supporting member comprising:

a pair of guides with means to fasten to said supporting member;

a floating link with means to surround said pair of guides;

a means to provide tether connection to said floating link from said flag;

a pivot housing with means to fasten to said supporting member; and a means to provide tether connection to said pivot housing from said flag.

2. The device of claim 1 further characterized by said pair of guides with means for enclosure of said supporting member and means for said floating link to levitate.

3. The device of claim 1 further characterized by said floating link with means to concatenate to a tether.

4. The device of claim 1 further characterized by said means to provide tether connection to said floating link comprising a connector and a length of material.

5. The device of claim 1 further characterized by said means to provide tether connection to said pivot housing including a means to connect a tether from apex of said pivot housing.

6. The device of claim 1 further characterized by the means to provide tether connection to said pivot housing comprising a pendant, a connector and a length of material.

7. A device to display and to tether a flag or a banner with a supporting member, demountably engaged with a mounting member comprising:

said mounting member with means to attach to a base and means to receive said supporting member;

said supporting member with means to attach to said mounting member;

a pivot housing with means to fasten to said supporting member;

a means to provide tether connection to said pivot housing from said flag;

a pair of guides with means to fasten to said supporting member;

a floating link with means to surround said pair of guides; and a means to provide tether connection to said floating link from said flag.

8. The device of claim 7 further characterized by said mounting member, angularly shaped, and said mounting member having a receptacle boss on one leg, and having a gusset spanning an area between said receptacle boss and an opposite leg, and said mounting member having mounting holes in both legs; and said supporting member comprising a plurality of elongated members, with a lowest section of said supporting member having an extensible end for receiving a lower end of a center section, and a lower end of said lowest section and said lower end of said center section both shaped to fit into said receptacle boss of said mounting member; a lower end of an uppermost section has an extensible end to fit into an upper end of said center section, and an upper end of said uppermost section fits into a receptacle area of said pivot housing.

9. A method of displaying a flag or a banner using a supporting member, said flag and a means for tethering said flag to said supporting member, said method comprising the steps of:

tether said flag at an appropriate connecting area of said flag to a pivot housing of said supporting member, and tether said flag at a lower appropriate connecting area of said flag to a floating link encircling a pair of guides located on said supporting member.

10. The method defined in claim 9 further comprising an additional step of attaching said supporting member to a mounting member, secured to a vertical plane, to display said flag in one of an angular and a horizontal position.

11. The method defined in claim 9 further comprising additional steps of attaching said supporting member to a mounting member and attaching said mounting member to a horizontal plane, to display said flag in one of a vertical and an angular position.

12. The method defined in claim 9 further comprising an additional step of imbedding said supporting member directly in a supportable substance to display said flag in a vertical position.

13. A method of displaying a variable number of flags or banners using a supporting member, said variable number of flags and a means for tethering said variable number of flags to said supporting member, said method comprising the steps of tether said variable number of flags at an upper appropriate connecting area of each of said variable number of flags to a floating link encircling a pair of guides for each of said variable number of flags located on said supporting member, tether said variable number of flags at a lower appropriate connecting area of said flags to a floating link encircling a pair of guides for each of said variable number of flags located on said supporting member, and attaching a terminus of said supporting member to a mounting member whereby said supporting member would be in a horizontal plane.

14. The method defined in claim 13 further comprising an additional step of attaching an opposite end of said supporting member to an opposite mounting member and attaching said opposing mounting member to a vertical plane, whereby said supporting member would be in a horizontal plane to display flags.

* * * * *